US005463844A

United States Patent [19]

Moehlenbrock et al.

[11] Patent Number: 5,463,844

[45] Date of Patent: Nov. 7, 1995

[54] MACHINE AND METHOD FOR PACKAGING POULTRY PRODUCTS

[75] Inventors: Andrew W. Moehlenbrock, Simpsonville; Joseph E. Owensby, Spartanburg; Thomas H. Bagwell, Simpsonville, all of S.C.

[73] Assignee: W. R. Grace & Co.-Conn., Duncan, S.C.

[21] Appl. No.: 108,370

[22] Filed: Aug. 18, 1993

[51] Int. Cl.[6] ..... B65B 1/24

[52] U.S. Cl. ..... 53/436; 53/469; 53/527; 53/258; 53/572; 426/410

[58] Field of Search ..... 426/129, 410; 53/113, 121, 428, 436, 469, 261, 255, 258, 526, 527, 572

[56] References Cited

U.S. PATENT DOCUMENTS

| | | | |
|---|---|---|---|
| 2,946,166 | 7/1960 | Baxter | 53/258 X |
| 4,023,329 | 5/1977 | Kupcikevicius et al. | 53/261 X |
| 4,033,088 | 7/1977 | Markert | 53/572 X |
| 4,057,951 | 11/1977 | Schneider . | |
| 4,141,194 | 2/1979 | Rochman . | |
| 4,147,012 | 4/1979 | Van Mil | 53/258 X |
| 4,157,003 | 6/1979 | Kamphaus | 53/258 X |
| 4,219,989 | 9/1980 | Andrews . | |
| 4,221,106 | 9/1980 | Altenpohl et al. . | |
| 4,245,453 | 1/1981 | Altenpohl et al. | 53/530 |
| 4,270,336 | 6/1981 | Altenpohl et al. . | |
| 4,352,263 | 10/1982 | Andrews, Jr. . | |
| 4,377,929 | 3/1983 | Altenpohl et al. | 53/258 X |
| 4,432,188 | 2/1984 | Andrews . | |
| 4,458,380 | 7/1984 | Tendick et al. . | |
| 4,464,882 | 8/1984 | Van Ginkel et al. | 53/258 X |
| 4,494,364 | 1/1985 | Meyn | 53/572 X |
| 4,510,733 | 4/1985 | Hansen et al. | 53/526 X |

FOREIGN PATENT DOCUMENTS

| | | | |
|---|---|---|---|
| 2903028 | 2/1980 | Germany | 53/572 |
| 3438599 | 4/1986 | Germany . | |
| 8006142 | 6/1982 | Netherlands | 53/255 |
| 1319048 | 5/1973 | United Kingdom | 53/258 |

*Primary Examiner*—John Sipos
*Assistant Examiner*—Daniel Moon
*Attorney, Agent, or Firm*—Mark B. Quatt

[57] ABSTRACT

A machine for packaging poultry products and for breaking the hocks of the poultry products includes two substantially semi-cylindrical guide members for positioning a poultry product with unbroken hocks in a bag and a plunger device for breaking the hocks of the poultry product. The plunger device has two inclined surfaces forming a substantially V-shaped surface for contacting the legs of the poultry product and for breaking the hocks by compressing the legs of the poultry product against the carcass of the poultry product. Methods for operating the machine to load the poultry product into the bag and to automatically break the hocks are also described.

7 Claims, 3 Drawing Sheets

MACHINE AND METHOD FOR PACKAGING POULTRY PRODUCTS

BACKGROUND OF THE INVENTION

The present invention relates to a machine and a method for packaging poultry products, particularly Cornish hens, and for breaking the hocks of the poultry products during the packaging operation.

Machines for automatically packaging poultry products in individual bags are well known in the art. U.S. Pat. Nos. 4,221,106 and 4,270,336, both to Altenpohl et al, illustrate such a machine. In the Altenpohl et al. machines, double leg suspended poultry products are dropped from a moving conveyor and guided into bags by a nozzle assembly which effects limited expansion of each bag in advance of the entry of each poultry product into the bag. A ram is provided to pack each poultry product fully into the bag after partial entry of the poultry product, resulting in tight fit packaging upon withdrawal of the ram and the nozzle assembly from the bag as it is detached and dropped onto a receiving surface.

One of the problems associated with packaging poultry products is the need to compress or compact the product so that it can be readily placed into a bag for further packaging. To this end, the hocks on the poultry product are broken to compress the legs against the body. A variety of different approaches have been used to solve this problem. U.S. Pat. No. 4,458,380 to Tendick et al. for example illustrates a machine wherein a cam actuated tray picks up the bird while it is hanging from shackles, and pushes the bird towards its legs so that the legs are forcibly flexed. U.S. Pat. No. 4,141,194 to Rochman illustrates a chicken packaging machine having tong-like gripper means for engaging the legs of a chicken as it comes from a conveyor and a hopper into which the gripper means forces the chicken. In the hopper, there is a bottom plate against which the chicken rests. While in this resting position, the chicken's thighs are pressed against its body by movement of a set of sleeves to which the gripper means are attached. After the chicken's thighs have been pressed against its body, the bottom plate is withdrawn and the compacted chicken is allowed to drop into a bag for further processing.

U.S. Pat. Nos. 4,219,989 and 4,432,188, both to Andrews, relate to a method of and apparatus for stretch bagging a poultry carcass. As described in these patents, a plurality of open-ended stretch bags are supported in superposed array. Pressurized air is forced into the top of the open-ended stretch bag so as to open the bag. Thereafter, the bag is stuffed with an inverted fowl carcass such that the breast plate is uppermost and the legs protrude rearwardly. As shown in FIG. 8 of each patent, the chicken's hocks are broken manually to compress or compact the bird within the package.

U.S. Pat. No. 4,352,263 to Andrews relates to an alternative method for stuffing a chicken carcass into a stretch plastic bag. The method is characterized by the alternate application of a central pushing force and a chicken leg pushing force, so as to hock or compress the chicken within the stretch bag.

Despite the existence of this packaging machinery for poultry products, there still remains a need for a machine that automatically breaks the hocks of the poultry product while facilitating the packaging thereof. There also remains a need for a machine that is not limited to the use of stretch bags.

SUMMARY OF THE INVENTION

It is an object of the present invention to provide a machine for packaging poultry products such as Cornish hens.

It is a further object of the present invention to provide a machine as above which automatically breaks the hocks of the poultry product being packaged.

It is also an object of the present invention to provide a method for packaging poultry products and automatically breaking the hocks of the poultry products being packaged.

The foregoing objects are readily attained by the machine and method of the present invention.

According to the present invention, a machine for packaging poultry products comprises means for providing a bag having an opening at one end, means for inserting the poultry product with unbroken hocks into the bag through the opening, and means for positioning the poultry product within the bag. The machine further includes means for breaking the hocks of the poultry product after it has been positioned within the bag.

In a preferred embodiment, the positioning means comprises two substantially semi-cylindrical product positioning guides located externally of the bag into which the poultry product is to be inserted. The guides move axially toward and away from each other between retracted and closed positions. In the closed position, the guides form a substantially cylindrical space and act as a support for the chicken placed into the bag. They also act as a hocking plate in this position. After the legs have been hocked, the guides are moved to their retracted position. This enables the bag with the packaged chicken to be released for further processing.

In said preferred embodiment, the hock breaking means comprises a plunger which at least partially enters the bag through the opening. The plunger has a substantially V-shaped internal surface for contacting the hocks and breaking them. The plunger preferably also includes a recessed portion for accommodating a rear or tail portion of the poultry product.

In operation, the machine provides a bag in an open position. In a first mode of operation, the product positioning guides are moved from the retracted position to the closed position wherein the guides substantially abut the bag and form a hocking plate. Thereafter, the poultry product or bird is gravity fed or air dropped into the bag. Following insertion of the bird into the bag, the plunger is actuated to contact the chicken thighs and compress them against the body of the chicken. Thereafter, the product positioning guides are retracted to an open position. The guides in this position create an opening through which the packaged chicken product passes or can be released. An alternative mode of operation is also described wherein the poultry product is placed in the bag before movement of the positioning guides to the closed position.

Other details, objects and advantages to the method and machine of the present invention are set out in the following description and drawings wherein like reference numerals depict like elements.

DETAILED DESCRIPTION OF PREFERRED EMBODIMENT(S)

Figure 1:
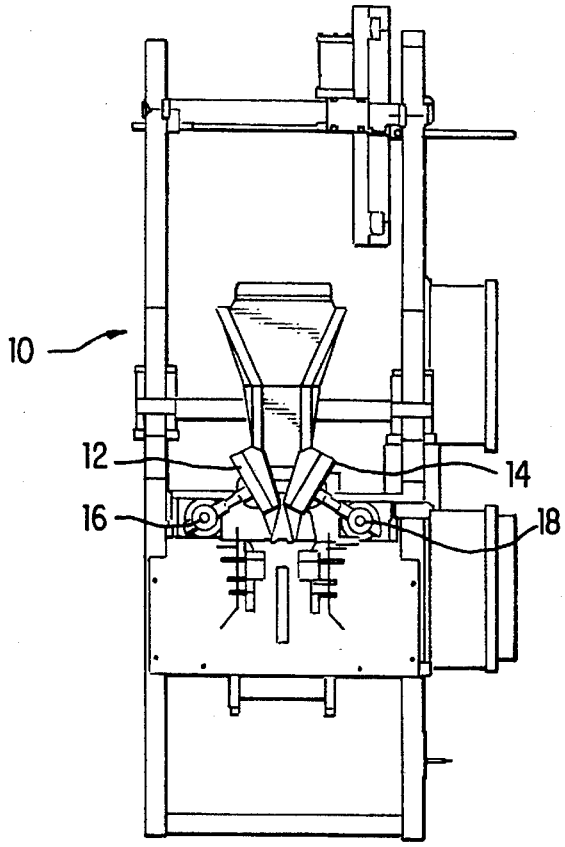
FIG. 1 is a front view of packaging machine in which the present invention can be employed.

Referring now to the drawings, FIG. 1 illustrates a prior art packaging machine 10 on which the present invention can be installed. The machine illustrated in FIG. 1 is a conventional Artran packaging machine. It is typically used in conjunction with a conveyor system (not shown) for transporting poultry products such as Cornish hens.

The packaging machine 10 includes a mechanism for holding a plastic bag in a desired location and an air injection assembly not shown for blowing the bag open. The machine 10 also includes product guides 12 and 14 which pivot about points 16 and 18 respectively outside of the line of loading. The product guides 12 and 14, which are typically powered by air cylinders (not shown), enter an opened end 20 of a bag 22 and hold it open for loading.

The packaging machine 10 differs from machines such as those shown in the Andrews patents in several respects. First, it does not require the use of stretch bags. Instead, it can use bags which are not designed to stretch significantly and which can shrink after being exposed to hot water at temperatures of approximately 195° F. Additionally, the packaging machine 10 does not require a table support for the article being packaged since the poultry product to be packaged is dropped substantially vertically or gravity fed from a conveyor system (not shown). Still further, no elevator system is employed to support the bag.

Figure 2:
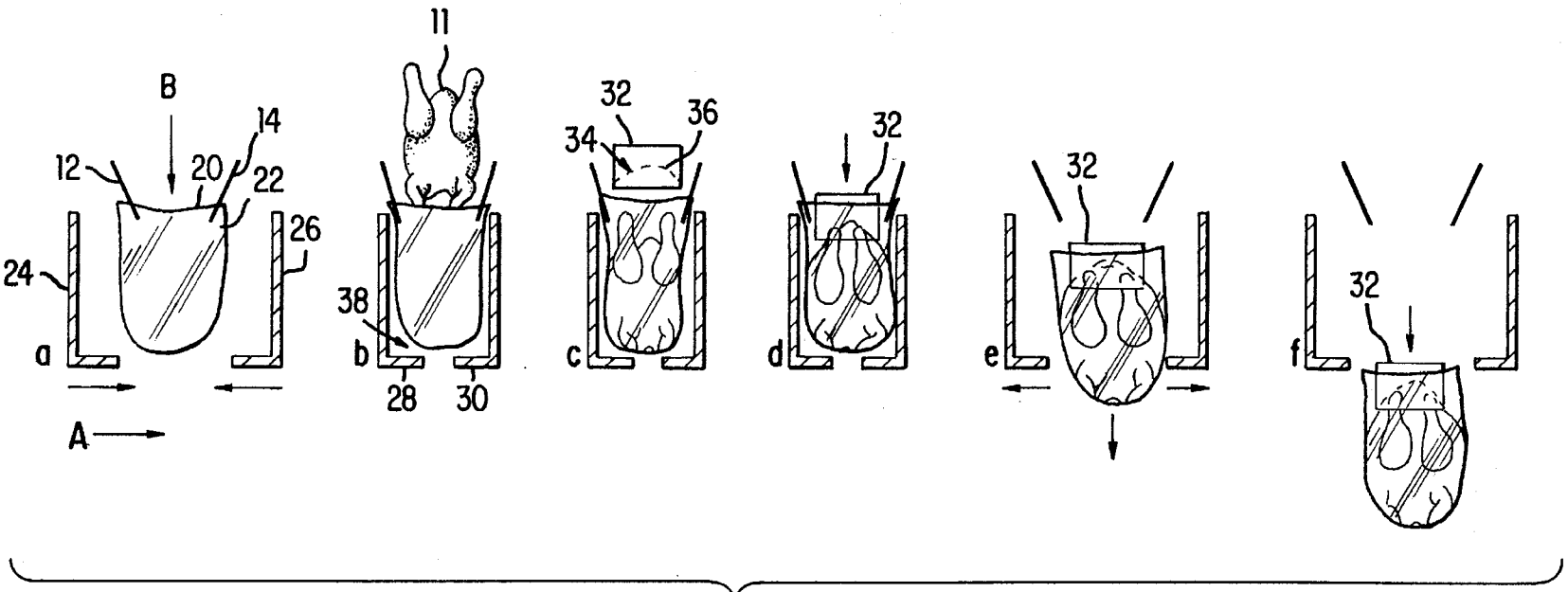
FIGS. 2(*a–f*) is a schematic representation of the improvements of the present invention and their operation.

FIGS. 2(*a*)–2(*f*) are a schematic representation of the improvements which can be made to a machine such as the packaging machine 10 to enhance its performance and to more easily pack poultry products. As shown therein, product positioning guides 24 and 26 are provided to position or locate a poultry product 11 with unbroken hocks within the bag 22. The product positioning guides are, in one embodiment, axially movable along an axis A substantially perpendicular to the drop axis B of the product being packaged. The guides 24 and 26 move between a retracted position (see FIG. 2(*a*)) and a closed position (see FIG. 2(*b*)). When in the closed position, the guides may actually contact each other or be spaced from each other. Preferably, the guides are spaced apart so that the substantially U-shaped or cylindrical space 38 created thereby is wide enough to accommodate relatively large poultry products. If desired, the guides 24 and 26 could be actuated so that initially they are spaced apart and then later are moved into a contact position. In an alternative embodiment, each of the product positioning guides pivot about an axis C substantially parallel to axis B between the retracted position and closed position (see FIG. 6).

Figure 6:
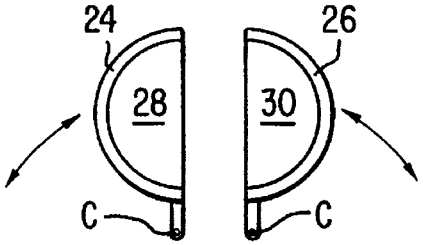
FIG. 6 is a top view of the product positioning guides forming part of the present invention.

The product position guides 24 and 26 are substantially semi-cylindrical in shape and have base portions 28 and 30 (see FIG. 6). Such a configuration is desirable from the standpoint of properly locating or positioning the poultry product in the bag prior to the hocking operation and from the standpoint of facilitating the hocking operation by supporting the periphery of the poultry product during it.

The guides 24 and 26 may be mounted to the machine 10 in any suitable manner. For example, the guides 24 and 26 along with plunger device 32 (discussed below) could be mounted in a subframe which can be movably attached to the ATRAN machine. Suitable means such as an air operated piston and cylinder assembly (not shown) may be used to move the guides between the retracted and closed positions. In addition, in a preferred embodiment the guides are held in contact position by suitable means, such as the air cylinder, which allows the guides to open slightly as the bird expands during the hock breaking operation.

In the closed position, the guides 24 and 26 form the substantially U-shaped or cylindrical space 38 about the bag. When the poultry product being packaged is dropped into the bag, the guides 24 and 26 locate it and hold it against unwanted movement, such as a rotational movement relative to the drop axis B. In the closed position, the base portions 28 and 30 of the guides also act as a hocking plate.

Figure 3:
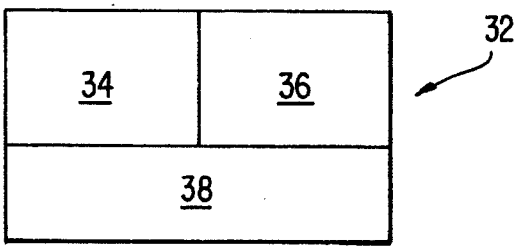
FIG. 3 is an end view of the plunger device forming part of the present invention.
Figure 4:
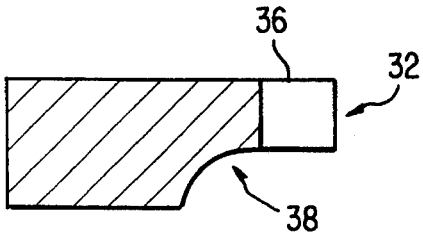
FIG. 4 is a cross sectional view of the plunger device of FIG. 3.

A further modification to the machine 10 is the inclusion of a plunger device 32 for breaking the hocks on the poultry product. As shown in FIG. 2(*d*), the plunger device 32 is at least partially inserted into the bag 22. As shown in FIG. 3, it has inclined internal surfaces 34 and 36, which together form a substantially V-shaped internal surface, for contacting the legs of the poultry product and breaking the hocks thereof. As used herein, the term "breaking the hocks" means compressing the legs of the poultry product against the carcass of the poultry product. As shown in FIGS. 3 and 4, the plunger device 32 also has a recessed portion 38 into which the rear portion of the poultry product 11 can fit.

The plunger device 32 is moved into and out of the bag 22 by a ram device (not shown). The ram device may comprise any suitable mechanism known in the art. For example, it could be a fluid actuated piston-cylinder arrangement. The plunger device and the ram device can be mounted to the machine 10 in any desired manner. Preferably, they are mounted so that the plunger can reciprocally move along the drop axis B.

As illustrated in FIGS. 2(*a*) through 2(*f*), the apparatus described herein operates in the following manner. The bag 22 is positioned in the machine 10 and inflated by an air nozzle assembly (not shown). The bag may also be inflated by other suitable means known in the art such as vacuum cups and the like. The product guides 12 and 14 are then rotated into a position wherein they partially extend into the bag 22. After the guides 12 and 14 have been moved into position, in one embodiment the product positioning guides 24 and 26 are moved from a retracted position (FIG. 2(*a*)) to a closed position (FIG. 2(*b*)). Thereafter, the poultry product to be packaged, with unbroken hocks, is dropped or gravity fed into the bag. As previously discussed, the guides 24 and 26 serve to locate the poultry product 11 so that it can not rotate relative to the drop axis B. Alternatively, the guides 24 and 26 may be moved to the closed position after the poultry product is dropped into the bag or concurrently therewith.

After the poultry product 11 has been inserted into the bag, the plunger 32 is actuated so as to move into the bag, contact the legs of the poultry product, and push the legs towards the base portions 28 and 30 of the guides 24 and 26 so as to break the hocks. After the hocks are broken, the guides 24 and 26 are moved to a retracted position wherein a space is created between them through which the bag with the poultry product therein can be released. As the guides move to the retracted position, the plunger, in one embodiment, continues movement along the drop axis to effect the release of the bag with the poultry product therein. In an alternate embodiment the plunger need not continue to advance and the poultry product can free fall by gravity.

As can be seen from the foregoing description, the device of the present invention provides numerous advantages. For example, it allows the poultry product to be packaged to be inserted into the bag in a less complex manner than machines requiring stretch bags and elevators. It also allows the poultry product to be well supported during the hock breaking operation. Still further, it allows the hock breaking operation to be performed automatically.

Figure 5:
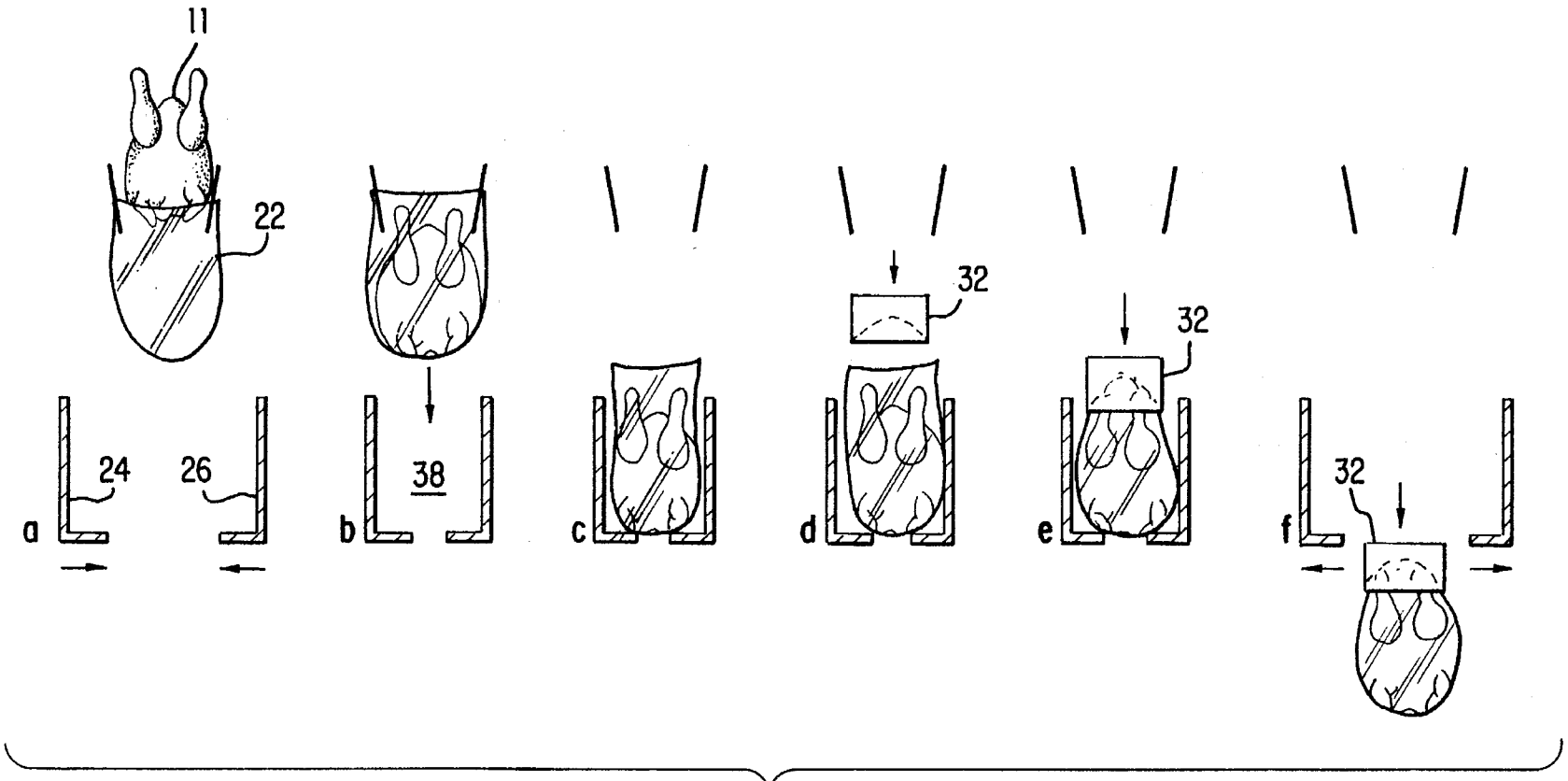
FIGS. 5(*a–f*) is a schematic representation of the improvements of the present invention and an alternative mode of operation.

FIGS. 5(*a*)–5(*f*) illustrate an alternative method for using the machine of the present invention. As shown in these figures, the poultry product 11 with the unbroken hocks is dropped or gravity fed into the bag while the guides 24 and 26 are in their retracted position. Thereafter, the guides 24 and 26 are moved into their closed position and the bag with the poultry product therein is released into the space 38 formed by the guides 24 and 26. After the poultry product and the bag are positioned within the guides, the plunger device 32 is actuated to break the hocks of the poultry product. After the hocks are broken, the guides 24 and 26 are actuated so as to move towards their retracted position while the plunger continues to push the bag and the poultry product therein through the space created by the moving guides 24 and 26.

It is apparent that there has been provided in accordance with this invention a machine and method for packaging poultry products and for breaking the hocks of the poultry products which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A machine for packaging poultry products which comprises:

a) means for providing a bag having an opening at one end;

b) means for dropping by gravity a poultry product with unbroken hocks downwardly along a vertical axis into said bag through said opening, said means for dropping including product guides at least partially inserted within said bag for guiding said dropped poultry product into said bag;

c) means for positioning said poultry product within said bag, said positioning means comprising two members located externally of said bag and movable towards and away from each other, the two members each substantially semi-cylindrical in shape and movable between an open position and a closed position, said members in said closed position acting as a hocking plate, and said members together defining, when in the closed position, a substantially cylindrical space in which said bag is positioned; and d) means for breaking the hocks of said poultry product, said means comprising a plunger which at least partially enters said bag through said opening.

2. The machine of claim 1 wherein said hock breaking means comprises a plunger having a substantially V-shaped internal surface for contacting the legs of the poultry product and breaking the hocks thereof.

3. The machine of claim 1 wherein said plunger further has a recessed portion for accommodating a rear portion of said poultry product.

4. The machine of claim 1 wherein said dropping means further comprises at least two product guides partially inserted into said bag.

5. The machine of claim 1 wherein said hock breaking means comprises a plunger which is partially inserted into said bag through said opening, said plunger having intersecting internal surface portions for contacting and breaking said hocks.

6. A method for packaging poultry products and for breaking the hocks of said poultry products which comprises the steps of:

a) providing a bag in an open position;

b) providing positioning guides for positioning a poultry product with unbroken hocks within said bag, said positioning guides comprising two members located externally of said bag and movable towards and away from each other, the two members each substantially semi-cylindrical in shape and movable between an open position and a closed position;

c) moving said positioning guides from a retracted position to a closed position defining a substantially cylindrical space, wherein said guides substantially abut said bag and form a hocking plate;

d) dropping by gravity said poultry product with unbroken hocks downwardly along a vertical axis into said bag;

e) breaking the hocks of said poultry product by at least partially inserting a hock breaking plunger into said bag;

f) moving said positioning guides from said closed position to said retracted position; and g) releasing said bag with said poultry product vertically downward through an opening created by the movement of said positioning guides.

7. A method for packaging poultry products and for breaking the hocks of said poultry products which comprises the steps of:

a) providing a bag in an open position;

b) providing positioning guides for positioning a poultry product with unbroken hocks within said bag, said positioning guides comprising two members located externally of said bag and movable towards and away from each other, the two members each substantially semi-cylindrical in shape and movable between an open position and a closed position;

c) dropping by gravity said poultry product with unbroken hocks downwardly along a vertical axis into said bag;

d) moving said positioning guides from a retracted position to a closed position defining a substantially cylindrical space, wherein said guides substantially abut said bag and form a hocking plate;

e) releasing said bag with said poultry product into said space;

f) breaking the hocks of said poultry product by at least partially inserting a hock breaking plunger into said bag;

g) moving said positioning guides from said dosed position to said retracted position; and h) releasing said bag with said poultry product vertically downward through an opening created by the movement of said positioning guides.

* * * * *